US005647073A

United States Patent [19]

Dorber, Sr.

[11] Patent Number: 5,647,073

[45] Date of Patent: Jul. 15, 1997

[54] PADDING SYSTEM ADAPTED FOR A SINK

[76] Inventor: Steven C. Dorber, Sr., P.O. Box 4043, Princeton, Fla. 33092

[21] Appl. No.: 592,973

[22] Filed: Jan. 29, 1996

[51] Int. Cl.[6] ..... E03C 1/186

[52] U.S. Cl. ..... 4/657; 4/661; 4/659; 4/639

[58] Field of Search ..... 4/657, 654, 655, 4/659, 639, 642, 628, 629, DIG. 18, 580, 581, 582, 290, 661

[56] References Cited

U.S. PATENT DOCUMENTS

| | | | |
|---|---|---|---|
| 2,421,808 | 6/1947 | Robertson | 4/657 |
| 2,522,612 | 9/1950 | Harben | 4/580 |
| 2,635,252 | 4/1953 | Gerue et al. | 4/657 |
| 3,931,652 | 1/1976 | Navarra | 4/DIG. 18 |
| 5,551,101 | 9/1996 | Leach | 4/580 |

*Primary Examiner*—Renee S. Luebke
*Assistant Examiner*—Charles R. Eloshway

[57] ABSTRACT

A padding system adapted for a sink including a sink insert having an open upper end, a closed lower end, a front wall, a rear wall, and two side walls. The sink insert is dimensioned for receipt within a sink. The closed lower end has a drainage aperture formed therethrough in a central portion thereof. The drainage aperture is disposed over an existing drain of a sink. The open upper end has a peripheral flange extending outwardly therefrom.

3 Claims, 2 Drawing Sheets

PADDING SYSTEM ADAPTED FOR A SINK

BACKGROUND OF THE INVENTION

1. Field of the Invention

The present invention relates to a padding system adapted for a sink and more particularly pertains to providing a padded surface within a sink to safely bathe a baby with a padding system adapted for a sink.

2. Description of the Prior Art

The use of bath tub pads is known in the prior art. More specifically, bath tub pads heretofore devised and utilized for the purpose of padding a bathtub for use are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,937,897 to Barnabie discloses a kneeling pad for bathtubs.

U.S. Pat. No. 4,037,591 to Sarno discloses a bath tub therapeutic pad.

Des. U.S. Pat. No. 260,281 to Rist discloses the ornamental design for an infant bath pad.

U.S. Pat. No. 5,216,764 to Hall et al. discloses a disposable bathtub and shower liner.

U.S. Pat. No. 5,144,703 to Maire discloses a bathtub liner.

U.S. Pat. No. 4,069,523 to Ridgeway discloses a bathtub with cushioned liner of foam plastic.

U.S. Pat. No. 4,051,563 to Clarke, Jr. discloses a cushioned liner for a bath tub.

While these devices fulfill their respective, particular objective and requirements, the aforementioned patents do not describe a padding system adapted for a sink for providing a padded surface within a sink to safely bathe a baby.

In this respect, the padding system adapted for a sink according to the present invention substantially departs from the conventional concepts and designs of the prior art, and in doing so provides an apparatus primarily developed for the purpose of providing a padded surface within a sink to safely bathe a baby.

Therefore, it can be appreciated that there exists a continuing need for new and improved padding system adapted for a sink which can be used for providing a padded surface within a sink to safely bathe a baby. In this regard, the present invention substantially fulfills this need.

SUMMARY OF THE INVENTION

In the view of the foregoing disadvantages inherent in the known types of bath tub pads now present in the prior art, the present invention provides an improved padding system adapted for a sink. As such, the general purpose of the present invention, which will be described subsequently in greater detail, is to provide a new and improved padding system adapted for a sink and method which has all the advantages of the prior art and none of the disadvantages.

To attain this, the present invention essentially comprises a sink insert having a generally rectangular configuration. The sink insert has an open upper end, a closed lower end, a front wall, a rear wall, and two side walls. The sink insert is dimensioned for receipt within a sink. The closed lower end has a drainage aperture formed therethrough in a central portion thereof. The drainage aperture is disposed over an existing drain of a sink. The closed lower end has a plurality of circular indentations formed therein in an equally spaced apart relationship. The open upper end has a peripheral flange extending outwardly therefrom. The device includes a mesh pocket having an open upper end, a closed lower end, a front wall, a rear wall, and two side walls. The rear wall of the mesh pocket is secured to one of the two side walls of the sink insert. The mesh pocket has a pair of divider walls therein thereby separating the mesh pocket into three compartments.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved padding system adapted for a sink which has all the advantages of the prior art bath tub pads and none of the disadvantages.

It is another object of the present invention to provide a new and improved padding system adapted for a sink which may be easily and efficiently manufactured and marketed.

It is a further object of the present invention to provide a new and improved padding system adapted for a sink which is of durable and reliable construction.

An even further object of the present invention is to provide a new and improved padding system adapted for a sink which is susceptible of a low cost of manufacture with regard to both materials and labor, and which accordingly is then susceptible of low prices of sale to the consuming public, thereby making such a padding system adapted for a sink economically available to the buying public.

Still yet another object of the present invention is to provide a new and improved padding system adapted for a sink which provides in the apparatuses and methods of the prior art some of the advantages thereof, while simultaneously overcoming some of the disadvantages normally associated therewith.

Even still another object of the present invention is to provide a new and improved padding system adapted for a sink for providing a padded surface within a sink to safely bathe a baby.

Lastly, it is an object of the present invention to provide a new and improved padding system adapted for a sink including a sink insert having an open upper end, a closed lower end, a front wall, a rear wall, and two side walls. The sink insert is dimensioned for receipt within a sink. The closed lower end has a drainage aperture formed therethrough in a central portion thereof. The drainage aperture is disposed over an existing drain of a sink. The open upper end has a peripheral flange extending outwardly therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
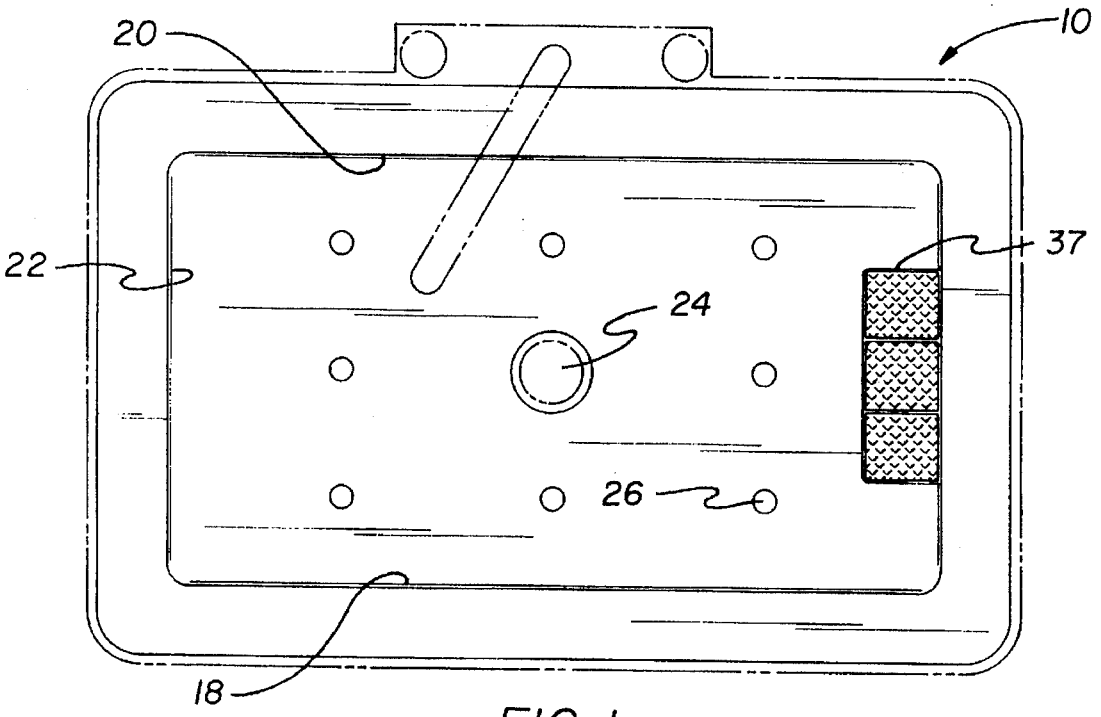
FIG. 1 is a plan view of the preferred embodiment of the padding system adapted for a sink constructed in accordance with the principles of the present invention.
Figure 2:
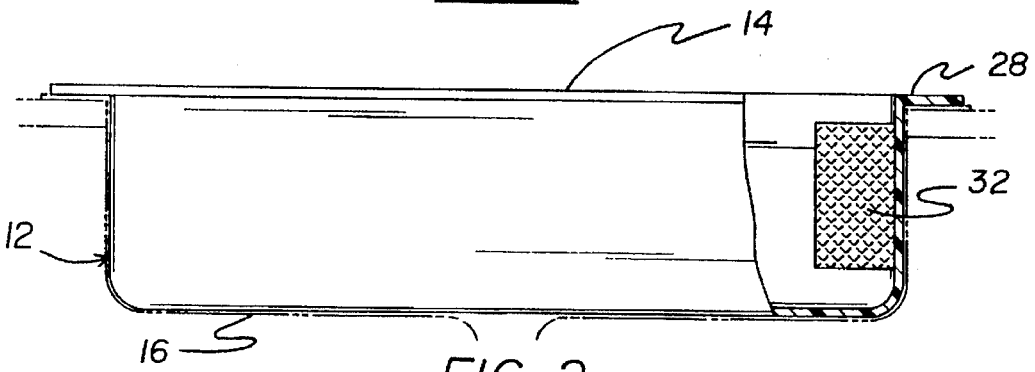
FIG. 2 is a side elevation view of the preferred embodiment of the present invention.

With reference now to the drawings, and in particular, to FIGS. 1–5 thereof, the preferred embodiment of the new and improved padding system adapted for a sink embodying the principles and concepts of the present invention and generally designated by the reference number 10 will be described.

Specifically, it will be noted in the various Figures that the device relates to a new and improved padding system adapted for a sink for providing a padded surface within a sink to safely bathe a baby. In its broadest context, the device consists of a sink insert and a mesh pocket. Such components are individually configured and correlated with respect to each other so as to attain the desired objective.

The device 10 includes a sink insert 12 having a generally rectangular configuration. The shape of the sink insert 12 can be varied to accommodate the differing shapes of sinks. The sink insert 12 has an open upper end 14, a closed lower end 16, a front wall 18, a rear wall 20, and two side walls 22. The sink insert 12 is dimensioned for receipt within a sink. The closed lower end 16 has a drainage aperture 24 formed therethrough in a central portion thereof. The drainage aperture 24 is disposed over an existing drain of a sink. The closed lower end 16 has a plurality of circular indentations 26 formed therein in an equally spaced apart relationship. The open upper end 14 has a peripheral flange 28 extending outwardly therefrom. The sink insert 12 is a molded, soft water resistant non-buoyant material approximately ½ inch in thickness. The circular indentations 26 are about ½ inch in diameter. The indentations 26 are designed to prevent a baby from slipping whiled positioned within the sink insert 12. The drainage aperture 24 is about three inches in diameter and serves to prevent the accumulation of water within the sink insert 12. The soft material of the sink insert 12 reduces the hazard of bruises on the baby when falling otherwise victimized by when in a hard surface sink.

The device 10 also includes a mesh pocket 32 having an open upper end 34, a closed lower end 36, a front wall 38, a rear wall 40, and two side walls 42. The rear wall 40 of the mesh pocket 32 is secured to one of the two side walls 22 of the sink insert 12. The mesh pocket 32 has a pair of divider walls 44 therein thereby separating the mesh pocket 38 into three compartments. The mesh pocket 32 allows for baby products and shampoos to be held nearby to aid in the bathing process of the baby.

Figure 3:
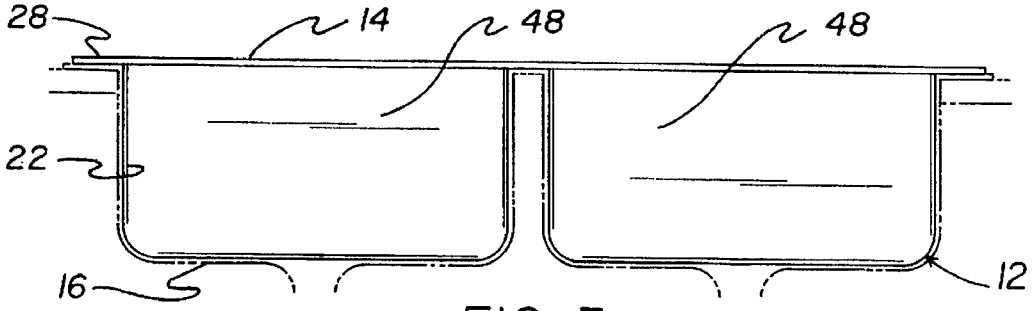
FIG. 3 is a side elevation view of a second embodiment of the present invention.
Figure 4:
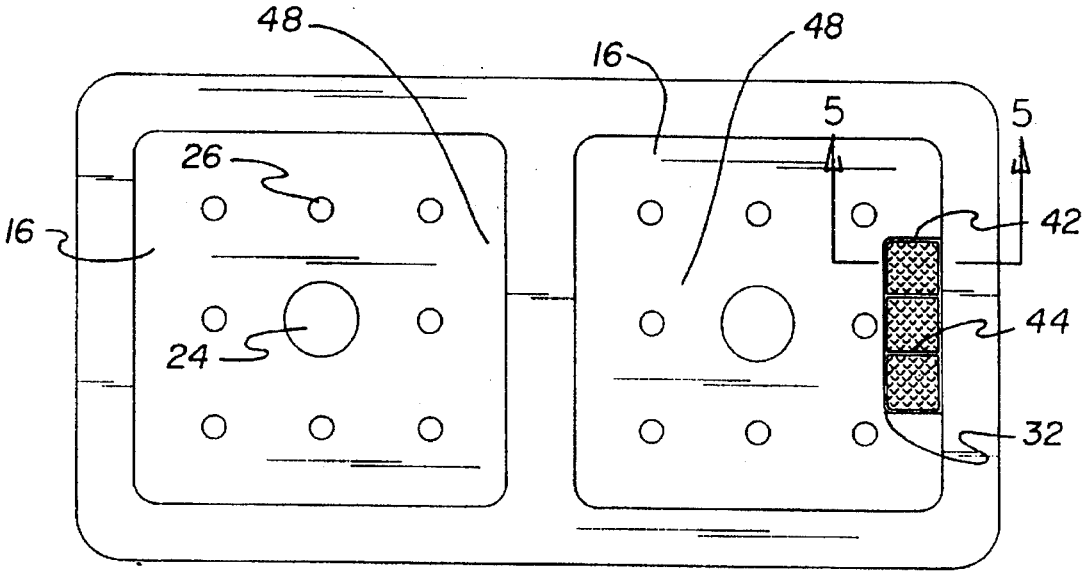
FIG. 4 is a plan view of the second embodiment of the present invention.
Figure 5:
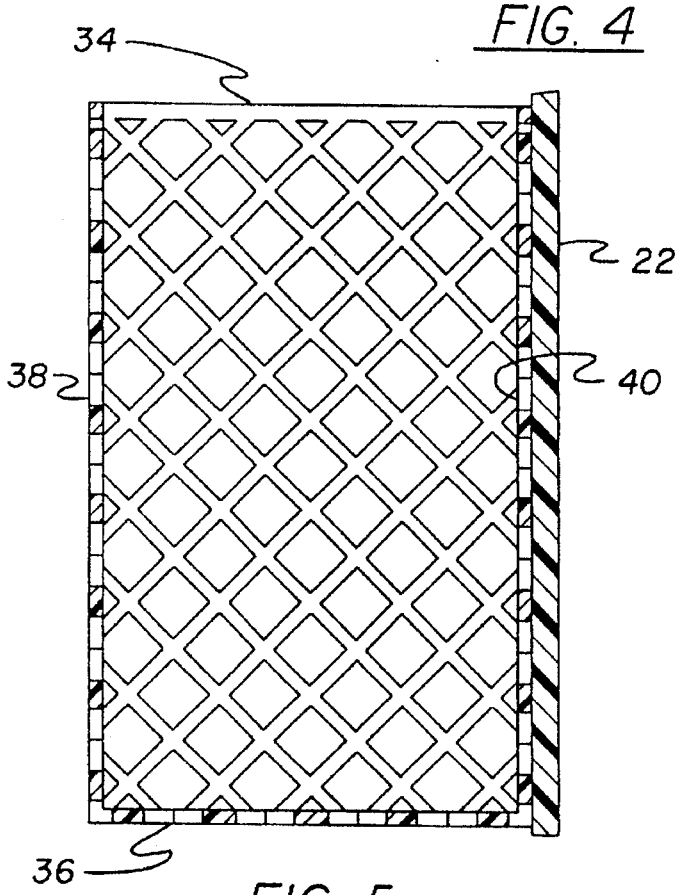
FIG. 5 is a cross-sectional view as taken along line 5—5 of FIG. 4.

A second embodiment of the present invention is shown in FIGS. 3–5 and includes substantially all of the components of the present invention wherein the open upper end of the sink insert is separated into two equally dimensioned compartments 48 for use in a double sink. Each of the compartments 48 has a drainage aperture 24 in its closed lower end 16.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A padding system adapted for a sink for providing a padded surface within a sink to safely bathe a baby comprising, in combination:

a sink insert having a generally rectangular configuration, the sink insert having an open upper end, a closed lower end, a front wall, a rear wall, and two side walls, the sink insert dimensioned for receipt within a sink, the closed lower end having a drainage aperture formed therethrough in a central portion thereof, the drainage aperture adapted to be disposed over an existing drain of a sink, the closed lower end having a plurality of circular indentations formed therein in an equally spaced apart relationship, the open upper end having a peripheral flange extending outwardly therefrom;

a mesh pocket having an open upper end, a closed lower end, a front wall, a rear wall, and two side walls, the rear wall of the mesh pocket secured to one of the two side walls of the sink insert, the mesh pocket having a pair of divider walls therein thereby separating the mesh pocket into three compartments.

2. A padding system adapted for a sink comprising:

a sink insert having an open upper end, a closed lower end, a front wall, a rear wall, and two side walls, the sink insert dimensioned for receipt within a sink, the closed lower end having a drainage aperture formed therethrough in a central portion thereof, the drainage aperture adapted to be disposed over an existing drain of a sink, the open upper end having a peripheral flange extending outwardly therefrom;

a mesh pocket having an open upper end, a closed lower end, a front wall, a rear wall, and two side walls, the rear wall of the mesh pocket secured to one of the two side walls of the sink insert, the mesh pocket having a pair of divider walls therein thereby separating the mesh pocket into three compartments.

3. The system as set forth in claim 2 wherein the open upper end of the sink insert is separated into two equally dimensioned compartments by a central wall extending between the front wall and the rear wall for use in a double sink.

* * * * *